United States Patent [19]

Jeghers

[11] 4,247,105

[45] * Jan. 27, 1981

[54] SET OF GOLF CLUBS

[75] Inventor: Philippe M. Jeghers, Herstal, Belgium

[73] Assignee: Fabrique National Herstal S.A., Herstal-lez-Liege, Belgium

[ * ] Notice: The portion of the term of this patent subsequent to Apr. 3, 1996, has been disclaimed.

[21] Appl. No.: 25,595

[22] Filed: Mar. 30, 1979

Related U.S. Application Data

[63] Continuation of Ser. No. 777,843, Mar. 15, 1977, Pat. No. 4,147,349, which is a continuation of Ser. No. 646,866, Jan. 5, 1976, abandoned.

[30] Foreign Application Priority Data

Dec. 18, 1975 [BE] Belgium ..... 54726

[51] Int. Cl.[3] ..... A63B 53/04

[52] U.S. Cl. ..... 273/77 A

[58] Field of Search ..... 273/77 R, 77 A, 164, 273/167–175

[56] References Cited

U.S. PATENT DOCUMENTS

| | | | |
|---|---|---|---|
| 622,699 | 4/1899 | Lowe | 273/167 R |
| 868,687 | 10/1907 | Myles | 273/167 F |
| 1,257,471 | 2/1918 | Fitzjohn et al. | 273/169 X |
| 1,617,090 | 2/1927 | Worthington | 273/169 X |
| 1,642,462 | 9/1927 | Reach | 273/77 A |
| 1,993,928 | 3/1935 | Glover | 273/169 X |
| 2,254,528 | 9/1941 | Hoare | 273/169 X |
| 2,447,967 | 8/1948 | Stone | 273/77 A X |
| 2,683,036 | 7/1954 | Klein | 273/167 F X |
| 2,784,969 | 3/1957 | Brandon | 273/77 A |
| 3,079,157 | 2/1963 | Turner | 273/167 A |
| 3,088,736 | 5/1963 | Mospan | 273/167 A X |
| 3,250,536 | 5/1966 | Moser | 273/169 X |
| 3,655,188 | 4/1972 | Solheim | 273/77 A |
| 3,751,035 | 8/1973 | Lockwood | 273/77 A |
| 3,862,759 | 1/1975 | Evans et al. | 273/167 A |
| 3,970,236 | 7/1976 | Rogers | 273/169 X |

FOREIGN PATENT DOCUMENTS

| | | | |
|---|---|---|---|
| 7365 | of 1912 | United Kingdom | 273/167 F |
| 377463 | 7/1932 | United Kingdom | 273/167 A |
| 1063798 | 3/1967 | United Kingdom | 273/167 A |

*Primary Examiner*—Richard J. Apley
*Attorney, Agent, or Firm*—Lyon & Lyon

[57] ABSTRACT

The invention pertains to a set of golf clubs of the type known as irons, wherein the center of gravity of each head is placed very low while the height of the frontal area of the heads is a constant throughout the set.

4 Claims, 10 Drawing Figures

SET OF GOLF CLUBS

This is a continuation of application Ser. No. 777,843 filed Mar. 15, 1977, now U.S. Pat. No. 4,147,349; which in turn is a continuation of application Ser. No. 646,866, filed Jan. 5, 1976, now abandoned.

FIELD OF THE INVENTION

The present invention relates to a set of golf clubs and more particularly to such clubs known as irons.

BACKGROUND

As all the mechanics involved in golfing have not yet been fully analyzed scientifically, it is not surprising that a relatively large number of theories have already been proposed in support of a large number of different shapes of club heads.

It is now an accepted fact that the speed at which a club head hits the ball and the relative position of the club head and ball at the moment of impact are the most important factors as far as length and accuracy of a drive are concerned.

SUMMARY OF THE INVENTION

An object of the invention is to provide a set of clubs of given weight, allowing any individual golfer to improve the length and accuracy of his drives.

This is achieved in so shaping the club heads of the set that the center of gravity of each head lies at a distance from the ground line of no more than 17 mm, while the ratio of the maximum height to the maximum width of each head is no more than 2.5.

The height of 17 mm corresponds to the normal impact point of a ball with a number 1 iron with the lowest loft known, that is to say with the highest impact point. It follows that the impact points of other heads in the set will always be below this 17 mm level. By so designing the heads that the center of gravity thereof also lays below the aforesaid level, the distance between the center of gravity and the impact point on the ball will be minimal, throughout the set.

This low position of the center of gravity also increases the length of the lever system constituted by the golfer and the club, so that the striking power of the head is increased.

The chosen limit of height/width ratio provides for a relatively small frontal area of the head. This reduces air drag of the club head and thus provides for faster swinging speeds as compared to known heads. Furthermore, the relatively small frontal surface indirectly increases the probability of the golfer hitting the ball with the "soft spot" of the head.

According to one feature of the invention, the height of said frontal area is a constant throughout the set, which together with the location of the center of gravity, facilitates "matching" of the clubs in the set.

In each head, the face is upwardly connected to the back of the head by a surface sloping upwards from front to rear at an angle of not less than 90° plus the loft angle. This provision allows the golfer to visualize the orientation of the face of the head.

BRIEF DESCRIPTION OF THE DRAWING

The invention will now be described in more detail with reference to the appended drawings showing one preferred embodiment of the invention and wherein.

DETAILED DESCRIPTION

Figure 2:
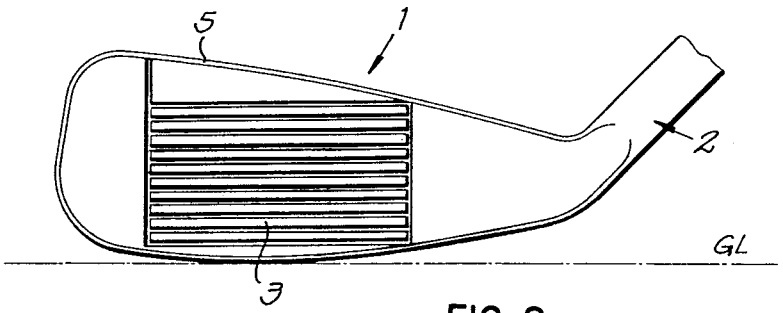
FIG. 2 is a view according to arrow F2 of FIG. 1.
Figure 1:
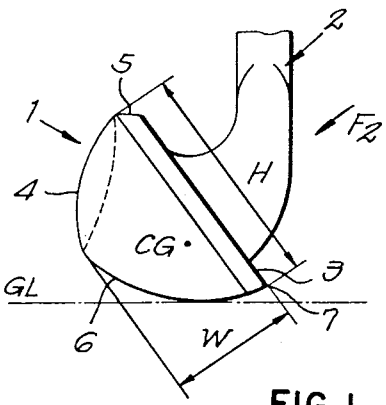
FIG. 1 is an end view of a club head according to the invention.

As shown in the drawings, a head according to the invention comprises a head proper 1 and a shank 2.

The center of gravity CG of the head is located at a distance from the ground line GL of not more than 17 mm.

The ratio of the maximum height H of the face 3, measured in the plane of that face, to the maximum width W of the head, measured perpendicularly to the aforesaid plane, is no more than 2.5 and, preferably, less than 2.

This leads to a relatively small frontal surface of the head, as compared to known club heads.

The face 3 is connected to the back 4 by a surface 5 which slopes upwards towards the rear of the head at an angle of not less than 90° plus the loft angle of the considered head. By this provision, face 3 and back 4 are visually separated so that the golfer may easily correctly orient face 3.

A set of heads according to the invention is shown in FIGS. 3–10. These heads may differ from one another in loft and lie angles, as well as in weight, as known per se.

As illustrated, the height A of the frontal areas of the heads in the set is a constant, while the center of gravity of each head is below the CG limit line, lying at 17 mm from the ground line CL.

The sole 6 of each head is preferably curved, both lengthwise and crosswise of the head, with the lower edge 7 of face 3 located at least at 2 mm from the ground line GL. This reduces the penetration of head into the ground when hitting an unteeed ball and also the penetration of the head into the ball when the latter is struck too high.

Figures 3, 4, 5, 6, 7, 8, 9, 10:
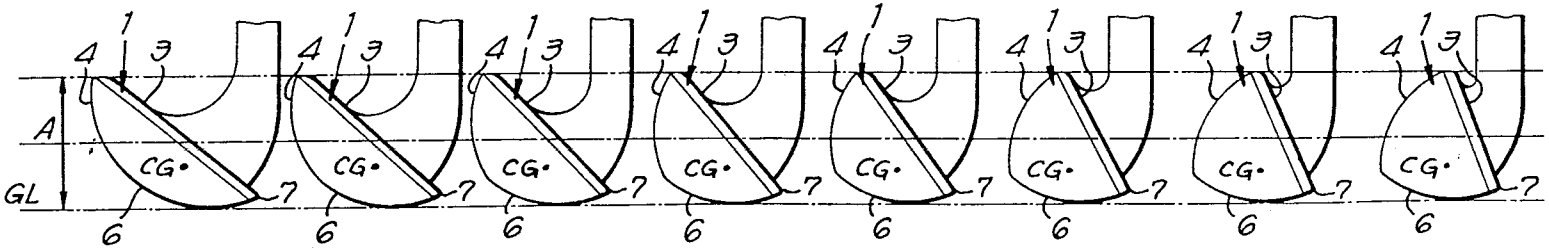
FIGS. 3–10 are end views of the various heads forming a set.

As illustrated, the sole 6 and back surface 4 are of different curvature for the club with least loft in FIG. 3 and the intersection of the curved surfaces is distinct whereas in FIG. 10 the sole 6 and back surface 4 blend smoothly, the other heads of the set having shapes of the sole and back surface varying therebetween. As further evident from the drawings, the ratio of the maximum height to maximum width is least for the head in FIG. 3 and greatest for the head in FIG. 10 and varies therebetween.

It will be understood that other embodiments of the invention may be contemplated, within the scope of the appended claims.

What I claim is:

1. A set of golf clubs, more specifically of irons going from a lowest number iron, each of said clubs being constituted by a shaft and a head, each of said heads comprising a shank and a head proper having a front striking face, a sole curved lengthwise and crosswise, and a curved back, said head and shank being homogeneous and made of metal, the height of the front striking face of each of the heads of said set in a plane perpendicular to the groundline being substantially constant, wherein the center of gravity of each of said heads lies at no more than 17 mm from the groundline and the ratio of the maximum height of said striking face, measured in the plane of the latter, to the maximum width of said head proper, measured perpendicularly to said plane, is less than 2.5, said heads of said set being shaped so that the distance between the center of gravity and the impact point on the ball will be minimal throughout the set, said heads of said set being differently shaped so that for heads of increasing loft, said ratio increases, said head of the lowest number iron with the smallest loft having the highest impact point, the remaining heads of the set having impact points less than that of said lowest number iron, said heads being shaped in said set so that the head with least loft has its back and sole surfaces of different curvature with distinct intersection whereas the head with maximum loft has its back and sole surfaces smoothly blending, the shape of the other heads of the set varying therebetween.

2. A set of golf clubs as claimed in claim 1 wherein the striking face of each head has a lower edge located at least 2 mm from the groundline.

3. A set of golf clubs as claimed in claim 1 wherein said head has an inclined surface connecting the upper edge of the striking surface with said back.

4. A set of golf clubs as claimed in claim 3 wherein said inclined surface slopes upwards towards said back at an angle not less than 90° plus the loft angle of the head.

* * * * *